United States Patent [19]

Garner et al.

[11] 4,150,728

[45] Apr. 24, 1979

[54] ROCK DRILL BIT INSERTS WITH HOLLOW BASES

[75] Inventors: Lloyd L. Garner, San Clemente; George R. Herrick, Irvine; Charles R. Harris, Whittier, all of Calif.

[73] Assignee: Smith International, Inc., Newport Beach, Calif.

[21] Appl. No.: 846,570

[22] Filed: Oct. 28, 1977

Related U.S. Application Data

[63] Continuation-in-part of Ser. No. 745,361, Nov. 26, 1976, abandoned.

[51] Int. Cl.[2] ..... E21B 9/08

[52] U.S. Cl. ..... 175/374; 175/410; 175/370; 175/372

[58] Field of Search ..... 175/374, 409, 410, 411; 76/101 E, 108 R, 108 A; 51/307, 309 R

[56] References Cited

U.S. PATENT DOCUMENTS

| | | | |
|---|---|---|---|
| 3,388,757 | 6/1968 | Fittinger | 175/410 |
| 3,599,737 | 8/1971 | Fischer | 175/410 X |
| 3,727,705 | 4/1973 | Newman | 175/374 |

*Primary Examiner*—Ernest R. Purser
*Assistant Examiner*—Richard E. Favreau
*Attorney, Agent, or Firm*—Christie, Parker & Hale

[57] ABSTRACT

A rock bit for drilling hard formations has a bit body with a plurality of rolling cone cutters mounted on it for rotation with rotation of the bit body. The cutters each have a plurality of recesses in their outer surfaces and a tungsten carbide insert is interference fitted into each of said recesses. A large diameter rock bit has such inserts larger than about ¾ inch diameter and a cavity is provided in the cylindrical base of such an insert. The cavity has a volume in the range of from about 15 to 30% of the volume of the cylindrical base and extends into the cylindrical base a distance of at least about 40% of the diameter of the base. The depth of the recess is more than half of the length of the portion of the insert that grips the recess in which it is inserted. Large savings in expensive tungsten carbide can be made without decreasing performance of the tungsten carbide inserts.

7 Claims, 4 Drawing Figures

61
92
66
94
26
72
64
96
65
87
92
62
62
25
87
4
4
65
85
61
87
25
64
80
72
78

ROCK DRILL BIT INSERTS WITH HOLLOW BASES

CROSS REFERENCE TO RELATED APPLICATIONS

This application is a continuation-in-part of U.S. patent application, Ser. No. 745,361, filed Nov. 26, 1976, now abandoned.

BACKGROUND

A common type of rock bit for drilling earth formations for forming oil and gas wells and the like has a rock bit body which rotates on the bottom of a drill string. The rock bit body has a plurality of rolling cone cutters mounted thereon for rotation upon rotation of the bit body. Commonly three such cutters are mounted on the rock bit body and occupy a separate 120° sector above the bottom of the hole being drilled. Each cutter has a generally conical configuration and is commonly known as a cone.

For drilling hard formations each cone is equipped with a number of generally circular rows of tungsten carbide inserts which bear on the rock being drilled to apply a high compressive load to the rock and cause its fracture. The cutting action of the rolling cone cutters is typically by a combination of crushing and chipping action of the inserts on the rock formation being drilled. The tungsten carbide inserts must therefore withstand high compressive loads and substantial transverse loading.

The tungsten carbide inserts are commonly mounted in cylindrical recesses in the outer surface of the cone. The inserts are made a few thousandths of an inch larger than the recess and are pressed in to have a tight interference fit to prevent withdrawal during usage.

There are several distinct shapes of tungsten carbide inserts which are standard in the rock bit industry, such as a conical, a double cone, a semi-projectile, and a chisel crest. Such inserts are characterized in having a generally cylindrical inner or base portion which fits into the recess in the rolling cone cutter. The cylindrical base can be slightly tapered. The outer end of such an insert converges to a work surface. The work surface is exposed beyond the surface of the cutter cone and applies the compressive loads to the rock being drilled.

In recent years, rather large size rock bits have been developed for drilling large size wells.

In such applications it is advantageous to use inserts having a diameter of about ¾ inch or larger. For example, by using such large diameter tungsten carbide inserts fewer rows of inserts and fewer inserts per row are required on each cone. Further the extension of the insert from the surface of the cone can be longer while maintaining adequate strength to avoid transverse failure during the drilling operation. This results in concentration of the drilling load on fewer inserts and consequently greater penetration of the rock being drilled without engagement of the surface of the steel rolling cone cutter on the bottom of the hole. This can result in appreciably improved drilling rates.

Large inserts which extend a greater distance from the surface of the rolling cone cutter can accommodate appreciable wear before it is necessary to withdraw the rock bit from a hole and replace it with a new bit. Thus, by using larger diameter inserts, it is sometimes possible to increase the lifetime of the bit as well as increasing the penetration rate.

An objection to the use of such large diameter inserts is the high cost of material required to form the inserts. The quantity of material required to form an insert increases with the square of the diameter of the insert. For tungsten carbide inserts having a diameter of about ¾ inch or larger, the incremental expense for forming the inserts is not justified by cost savings realized from using fewer inserts.

It is therefore desirable to provide inserts having a diameter in excess of about ¾ inch which can be prepared at a cost approaching the cost of smaller diameter inserts. Such economies in manufacture can make large diameter rock bits economically feasible since the drilling rates are significantly improved.

There is, therefore, provided in practice of this invention a large tungsten carbide insert having a large cavity in the cylindrical base portion. Such a cavity extends into the base a distance of at least about 40% of the diameter of the cylindrical base and has a volume in the range of from about 15 to 30% of the volume of the base.

Small dimples in the base of tungsten carbide inserts for earth boring rock bits have been used to provide clearance between the base of the insert and the bottom of the recess in the cone. Such clearance dimples are shown in U.S. Pat. Nos. 3,388,757 to Fittinger and 3,599,737 to Fischer. The depth of such dimples was generally less than about 10% of the diameter of the cylindrical base portion of such inserts and no case is known where the distance the dimple extended into the base exceeded about 25% of the diameter of the cylindrical base. The dimple in such an insert did not extend any appreciable distance into the grip portion of the insert.

No substantial saving in tungsten carbide is provided by such minor dimples in the base of the tungsten carbide inserts. Further, such dimples have been provided in the bases of relatively small diameter tungsten carbide inserts. Dimples of appreciable volume are not feasible in such small inserts.

BRIEF SUMMARY OF THE INVENTION

There is, therefore, provided in practice of this invention according to a presently preferred embodiment an earth drilling rock bit comprising a body with a plurality of rolling cone cutters mounted thereon. Such a rolling cone cutter has a plurality of recesses in its outer surface and each recess receives a tungsten carbide insert. Such an insert comprises a cylindrical base portion with a diameter of at least about ¾ inch and an end portion converging to form a work surface extending beyond the outer surface of the rolling cone cutter. Such an insert has a cavity opening to the inner end of the insert with a volume in the range of from about 15 to 30% of the volume of the base portion of the insert. The cavity extends into the base portion a distance of at least about 40% of the diameter of the cylindrical base. The depth of the cavity is more than half the length of the grip portion of the insert, that is, the portion that grips the wall of the recess when interference fitted therein.

DRAWINGS

These and other features and advantages of the present invention will be appreciated as the same becomes better understood by reference to the following detailed description and accompanying drawings wherein.

DESCRIPTION

Figure 1:
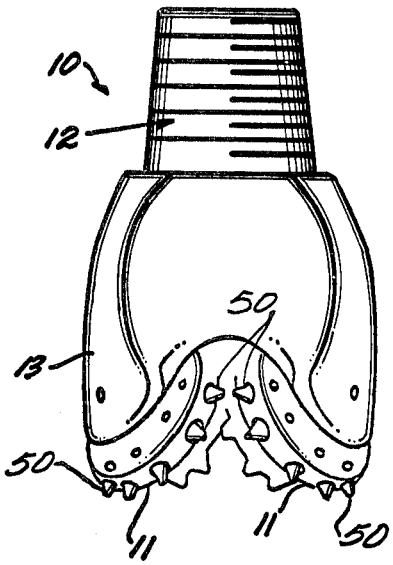
FIG. 1 is a pictorial view of a rock bit having three rolling cone cutters mounted thereon.

FIG. 1 is a side view of an earth boring rock bit 10 having three generally conical rolling cutters 11. The conical cutters 11 may also be referred to herein as cones, rolling cone cutters, or the like. The rock bit has a heavy duty steel body which is typically constructed by welding three separately forged legs 13 together to form an integral body. After welding, a threaded pin joint 12 is machined on the upper end of the rock bit body. During use the pin joint 12 is connected to the lower end of a drill string which is rotated in a well bore or the like for earth drilling.

Each leg has at its lower end a journal 14 on which the respective cutter cones 11 are mounted. During assembly the cone 11 is placed on the journal 14 and ball bearings 15 are added through a ball passage 16 from the exterior of the leg to a ball bearing race between the journal pin 14 and cone. The ball passage is then closed with a ball retainer 17 which retains the ball bearings in place. Typically the ball retainer is welded in place as indicated at 18. The ball bearings 15 may carry some minor thrust loads between the journal and cone, but a principal function of the balls is to retain the cone on the journal.

A nose bearing 20 on the journal pin engages a thrust button 21 in the cone for carrying the principal thrust loads of the bearing structure. The brunt of the radial loads between the cone and journal are carried by the main cylindrical bearing surfaces 22. The solid journal bearings and ball bearings are lubricated by grease in communication with a conventional lubricant passage 19 and retained by a sealing O-ring 23. In other embodiments the cone is mounted on the journal pin by means of roller bearings instead of the friction bearing 22 illustrated in FIG. 2.

Figure 2:
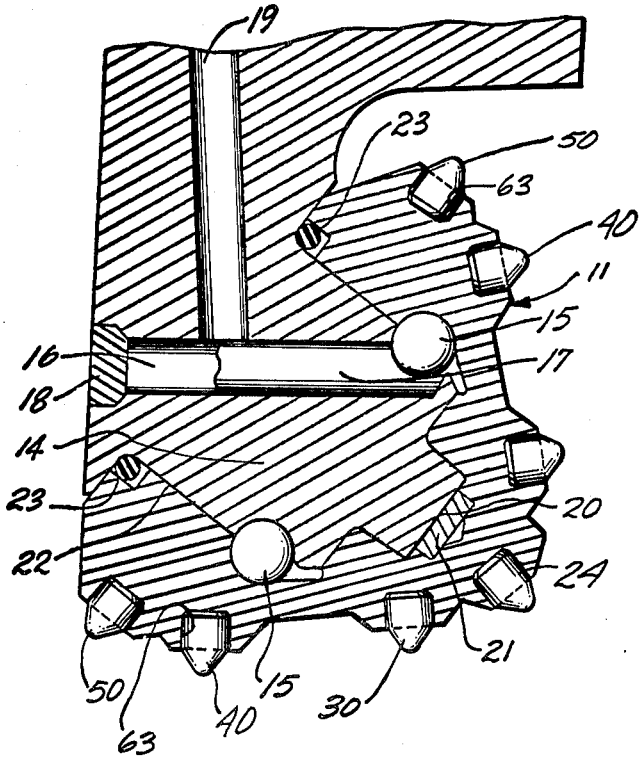
FIG. 2 is a longitudinal cross-sectional view through one leg and a rolling cone cutter of the rock bit of FIG. 1.

In the nose of the cone 11 illustrated in FIG. 2 a single insert 24 is mounted in a recess opening to the outside surface 25 of the cone. A first inner circular row of tungsten carbide inserts 30 is mounted near the forward end of the cone and an additional inner row of tungsten carbide inserts 40 is mounted on the cone towards its larger diameter base. Each rolling cone cutter also has an outermost row of tungsten carbide inserts 50 generally referred to as the gage row. The inserts in the gage row are at the periphery of the hole being drilled and maintain its full gage.

As the rock bit rotates during drilling each cone rolls on the bottom of the hole being drilled. The gage inserts 50 engage the bottom of the hole adjacent the peripheral wall of the bore hole formed by the drill bit in the rock formation. The inner rows 30 and 40 engage the bottom of the bore hole. The spacing of the inserts within the rows 30, 40 and 50 and the locations of the rows on individual rolling cone cutters may be varied in a variety of conventional manners to minimize tracking and maximize cutting efficiency.

The inserts are mounted in the cutter cones in mounting recesses 63. The diameter of the cylindrical base of an insert is slightly larger than the diameter of the recess in which it is mounted. Each insert is forced into its recess and held in place by the resultant interference fit between it and the wall of the recess. This much of the rock bit is conventional and representative of a number of design variations that may be present in rock bits.

Figures 3, 4:
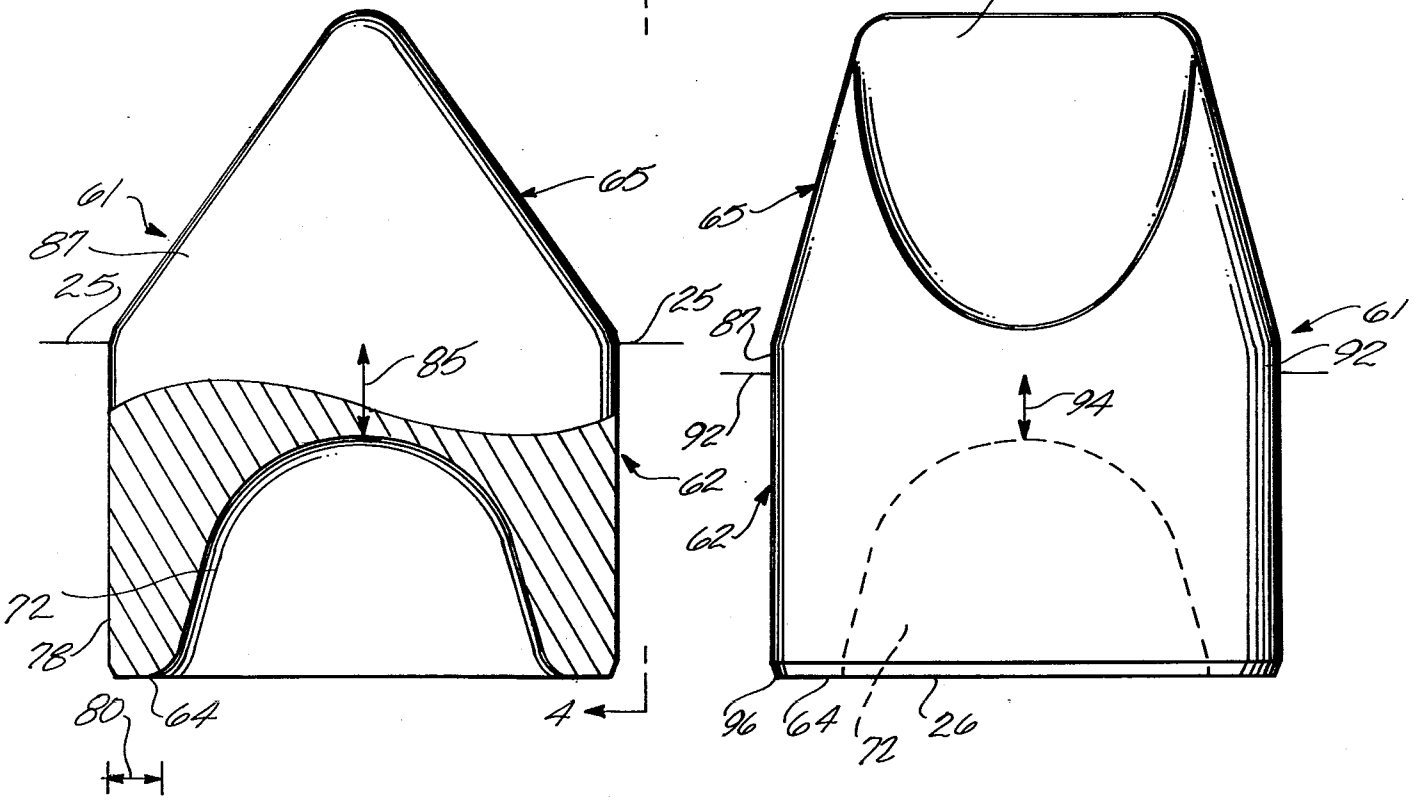
FIG. 3 is a side view of a tungsten carbide insert for a rock bit, partially in section.
FIG. 4 is another side view of the insert.

A tungsten carbide insert 61 for mounting in a rolling cone cutter of such a rock bit is illustrated in FIGS. 3 and 4. Such an insert comprises a generally cylindrical base 62 which is inserted into the recess in the cutter until the end 64 engages the bottom of the recess. The outer end 65 of the insert which extends beyond the outer surface 25 of the cutter cone converges to form a work surface 66 which engages the rock being drilled. The insert 61 illustrated in FIGS. 3 and 4 is a chisel crest insert; a variety of other inserts having converging end portions 65 known in the art can be used in practice of this invention.

Tungsten carbide inserts for rock bits are made by a powder metallurgy technique. Tungsten carbide powder having an average size of only a few microns is thoroughly mixed with about 6 to 16% by weight of a binder metal powder, such as cobalt. A small amount of wax is included to serve as a temporary binder for the powder mixture. Such a mixture is compressed in a high pressure hydraulic press to form a "green" compact. The compact is heated at a relatively low temperature to remove wax and then sintered at a temperature slightly below the melting point of the binder metal. This forms a very hard dense body of tungsten carbide particles bonded together by the cobalt with appreciable shrinkage from the dimensions of the "green" compact. Care must be used in design and pressing to avoid uncontrolled warpage of the insert during sintering. The sintered inserts are ground on the cylindrical base portion to have a closely controlled diameter and undergo 100% inspection. A principal factor in the cost of tungsten carbide inserts is the cost of the tungsten carbide powder. The tooling expense for high strength punches and dies for the pressing operation, sintering equipment, diamond grinding equipment, and special inspections also contribute to cost.

In practice of this invention a deep cavity 72 is provided in the cylindrical base portion of the insert. The cavity 72 extends into the base from the end surface 64. Thus, the cavity is enclosed by the base and opens only to the end surface 64 inserted into a recess in the cutter cone.

It is desirable to make the cavity 72 as large as possible to minimize the quantity of material required for forming the insert. However, as the size of the cavity is increased relative to the base of the insert, there is more likelihood of failure of the insert during use of the rock bit, particularly by transverse failure generally parallel to the cone surface 25. The cavity is therefore maintained at a size sufficiently small that failure of the insert does not occur during drilling.

When the diameter of the insert is from about $\frac{3}{4}$ inch to about $1\frac{1}{4}$ inch, the volume of the cavity is preferably in the range of from about 15 to 30% by volume of the cylindrical base of the insert. The volume of the base is calculated as if there were no cavity therein. For example, an insert having a 0.64 cubic inch base and a 0.16 cubic inch cavity in the base requires only 0.48 cubic inch of material to form the base. The volume of the cavity is 25% of the volume of the base and substantial savings of tungsten carbide can be effected. If the volume of the cavity is less than about 15% of the volume of the base of the insert, the resultant savings in tungsten carbide do not justify the added cost of tooling and processing needed for pressing, sintering and inspecting the tungsten carbide inserts. If the volume of the cavity exceeds about 30% of the volume of the cylindrical base, there can be undue weakening of the insert with a potential for failure of the insert or excessive bearing loads between the insert and steel cone.

The cavity in the base is circularly symmetrical for ease of fabrication of the insert. Circular symmetry of the cavity is desirable to avoid interactions between the wall or bottom of the recess and the tungsten carbide insert during use of the drill bit. Such interactions between the insert and recess might cause rotation of the tungsten carbide insert relative to the recess within which it is mounted during use of the rock bit. Such rotation could result in reduction of effectiveness of drilling for a tungsten carbide insert having an asymmetrical working surface such as the chisel crest illustrated in FIGS. 3 and 4.

The wall thickness of the base, that is the distance between the periphery of the cavity 72 and the outside surface 78 of the base is at least about ⅛ inch to avoid undue weakening of the insert. The minimum thickness of the base of the insert is indicated in FIG. 3 by a double pointed arrow 80.

The depth of the cavity, that is the distance the cavity 72 extends from the end surface 64 of the base is at least 40% of the diameter of the cylindrical base portion of the insert and is preferably about 50% of the diameter. Such a deep cavity can have sufficient volume that the savings in tungsten carbide justify the cost of tooling, processing, and inspection of the tungsten carbide insert while still maintaining adequate wall thickness for the base portion and sufficient draft on the sides of the cavity to give good functioning of the punch used in the pressing operation for forming the tungsten carbide insert. Preferably the cavity has a depth such that its closest approach to the outer surface of the cutter cone is no more than about 3/16 of an inch; that is, there is about 3/16 inch of tungsten carbide from the surface 25 of the cone to the bottom of the cavity 72. Such a distance is indicated by the double ended arrow 85 in FIG. 3.

A tungsten carbide insert for a rock bit usually has a small chamfer 96 at its inner end to aid in pressing of the insert into the recess in the cutter cone. When the insert is pressed into the recess some damage to the steel of the cone can occur near the mouth of the recess. This damage effectively enlarges the diameter of the recess slightly near the surface of the cone. In this region the steel of cone may not grip the tungsten carbide insert. The portion of the base actually gripped by the steel of the cutter cone is known as the grip length. This is the length of the cylindrical portion of the base between the chamfer 96 and the line 92 indicated in FIG. 4. It is found that damage to the walls of the recess can occur in about the first 1/16 inch of the recess below the outer surface 25 of the cutter cone. Thus, the grip length can be up to about 1/16 inch less than the length of the cylindrical portion of the base.

It is preferred that the depth of the cavity be appreciably more than half the grip length. Tests show that with a cavity having such a large depth, substantial cost savings can be effected and the ability of the insert to remain in the recess during use is not compromised. Thus, despite the hollow base, good engagement between the insert and the steel cone is retained. By providing such a deep cavity, the savings in tungsten carbide can justify the costs of tooling, processing and inspection for a tungsten carbide insert having a hollow base.

Preferably the bottom of the cavity is no closer than about ⅛ inch to the outer end of the nominal grip length, as indicated by the double ended arrow 94 in FIG. 4. This is essentially equivalent to having the bottom of the cavity no closer than about 3/16 inch from the outer surface 25 of the cutter cone.

It is significant that the insert has a diameter of at least about ¾ inch. A deep cavity provided in the base of an insert smaller than about ¾ inch can result in appreciable weakening of the insert without concomitant benefit. The small amount of savings due to reduction in use of tungsten carbide may not justify the costs of tooling, processing and inspection in forming such hollow inserts.

Use of inserts having a deep cavity as hereinabove described has many advantages. In particular, high drill penetration rates are possible because of deeper penetration and higher concentration of drilling loads on a few large inserts than is possible with a large number of smaller inserts. The advantages of high penetration rate can be realized without increasing the cost of the rock bit and there can actually be lower cost by using large diameter hollow inserts as compared with conventional small diameter solid inserts. This occurs since fewer inserts are required and increased cost of materials for forming large inserts is avoided by making such inserts with deep cavities as hereinabove described.

EXAMPLE

A 26 inch diameter rock bit has hollow tungsten carbide inserts in cutter cones as provided in practice of this invention. The total length of such an insert of the chisel crest type as illustrated in FIGS. 3 and 4 is about 1.374 inch and the length of the cylindrical base portion is about 11/16 inch. The diameter of the cylindrical base is about 1.0028 inch. A circularly symmetrical cavity is centrally located in the base of the insert with a diameter as measured at the end surface 64 of about 0.745 inch. Thus, the minimum wall thickness of the base is about 0.126 inch. The volume of the cavity is about 0.16 cubic inch which is equal to about 29.5% of the volume of the base without the cavity. The cavity is about ½ inch deep with a shape substantially as shown in FIG. 3. Thus, the cavity has a depth more than 70% of the grip length and about 50% of the diameter of the base. Such a tungsten carbide insert can be made for about 25% less than a comparable tungsten carbide insert not having a cavity in the base. A cost saving of about $300 is effected in each such 26 inch diameter bit by using such inserts, without any decrease in quality or performance as compared with a bit with comparable size solid inserts and an increase in performance as compared with a bit having smaller diameter inserts.

Although this invention has been described in detail with respect to certain embodiments thereof, there are other versions within the scope of this invention. It is therefore to be understood that within the scope of the appended claims, the invention may be practiced otherwise than as specifically described.

What is claimed is:

1. An earth drilling rock bit comprising:

a rock bit body;

a plurality of rolling cone cutters mounted on the rock bit body;

a plurality of recesses opening to an outer surface of such a rolling cone cutter; and a tungsten carbide insert interference fitted into each of such recesses;

such a recess having a cylindrical wall portion extending away from the outer surface of the rolling cone cutter and a bottom portion for engaging the inner end of such an insert; and such an insert comprising:

a cylindrical base portion with a diameter of at least about $\frac{3}{4}$ inch, the diameter of the base portion being larger than the diameter of the cylindrical recess for providing an interference fit along the base portion of the insert;

an end portion converging from the outer end of the base portion to form a work surface extending beyond the outer surface of the rolling cone cutter; and a cavity opening to the inner end of such insert in the recess opposite the work surface of such insert, the cavity extending into the cylindrical base portion a distance of at least about 40% of the diameter of the cylindrical base portion and having a volume in the range of from about 15 to 30% of the volume of the base portion of the insert, the minimal wall thickness of the base portion of such insert between the cavity and the cylindrical surface of the base portion being at least about $\frac{1}{8}$ inch.

2. An earth drilling rock bit comprising:

a rock bit body;

a plurality of rolling cone cutters mounted on the rock bit body;

a plurality of recesses opening to an outer surface of such a rolling cone cutter; and a tungsten carbide insert interference fitted into each of such recesses;

such a recess having a cylindrical wall portion extending away from the outer surface of the rolling cone cutter and a bottom portion for engaging the inner end of such an insert; and such an insert comprising:

a base portion having a cylindrical grip portion with a diameter of at least about $\frac{3}{4}$ inch, the diameter of the grip portion being larger than the diameter of the cylindrical recess for providing an interference fit along the grip portion of the insert;

an end portion converging from the outer end of the base portion to form a work surface extending beyond the outer surface of the rolling cone cutter; and a cavity opening to the inner end of such insert in the recess opposite the work surface of such insert, the cavity extending into the base portion a distance more than about one-half of the length of the grip portion, the minimal wall thickness of the grip portion of such insert between the cavity and the cylindrical surface of the grip portion being at least about $\frac{1}{8}$ inch.

3. A rock bit as recited in claim 2 wherein the cavity has a volume in the range of from about 15 to 30% of the volume of the base portion of the insert.

4. A rock bit as recited in claim 3 wherein the cavity extends into the base portion a distance of at least about 40% of the diameter of the cylindrical base portion.

5. A rock bit as recited in claim 4 wherein the bottom of the cavity is at least 3/16 inch below the outer surface of the rolling cone cutter.

6. An earth drilling rock bit comprising:

a rock bit body;

a plurality of rolling cone cutters mounted on the rock bit body;

a plurality of recesses opening to an outer surface of such a rolling cone cutter; and a tungsten carbide insert interference fitted into each of such recesses;

such a recess having a cylindrical wall portion extending away from the outer surface of the rolling cone cutter and a bottom portion for engaging the inner end of such an insert; and such an insert comprising:

a cylindrical base portion with a diameter of at least about $\frac{3}{4}$ inch, the diameter of the base portion being larger than the diameter of the cylindrical recess for providing an interference fit along the base portion of the insert;

an end portion converging from the outer end of the base portion to form a work surface extending beyond the outer surface of the rolling cone cutter; and a cavity opening to the inner end of such insert in the recess opposite the work surface of such insert, the cavity extending into the base portion a distance of at least about 40% of the diameter of the cylindrical base portion.

7. A rock bit as recited in claim 6 wherein the cavity has a volume in the range of from about 15 to 30% of the volume of the base portion of the insert.

* * * * *